US010028549B2

(12) United States Patent
Ferniani et al.

(10) Patent No.: US 10,028,549 B2
(45) Date of Patent: Jul. 24, 2018

(54) METHODS AND APPARATUS FOR MANUFACTURING ARTICLES OF FOOTWEAR INCLUDING DIFFERENT MATERIALS

(71) Applicant: CROCS, INC., Niwot, CO (US)

(72) Inventors: Stefano Ferniani, Padua (IT); Tony Xie, Shenzhen (CN)

(73) Assignee: Crocs, Inc., Niwot, CO (US)

( * ) Notice: Subject to any disclaimer, the term of this patent is extended or adjusted under 35 U.S.C. 154(b) by 9 days.

(21) Appl. No.: 14/808,987

(22) Filed: Jul. 24, 2015

(65) Prior Publication Data

US 2016/0021973 A1 Jan. 28, 2016

Related U.S. Application Data

(60) Provisional application No. 62/028,754, filed on Jul. 24, 2014.

(51) Int. Cl.

| | |
|---|---|
| ***A43B 9/00*** | (2006.01) |
| ***A43D 95/14*** | (2006.01) |
| ***A43D 97/00*** | (2006.01) |

(52) U.S. Cl.

CPC ..... *A43B 9/00* (2013.01); *A43D 95/14* (2013.01); *A43D 97/00* (2013.01); *A43D 2200/50* (2013.01)

(58) Field of Classification Search

None

See application file for complete search history.

(56) References Cited

U.S. PATENT DOCUMENTS

| | | | |
|---|---|---|---|
| 3,264,157 | A | 8/1966 | Lattimer |
| 6,439,536 | B1 | 8/2002 | Piccolo |

FOREIGN PATENT DOCUMENTS

| | | |
|---|---|---|
| CN | 1655701 A | 8/2005 |
| WO | WO-03/094647 | 11/2003 |

OTHER PUBLICATIONS

Chinese Office Action issued by the Chinese Patent Office for Chinese Patent Application No. 201510441328.1, dated Feb. 3, 2017, 5 pages.

*Primary Examiner* — Monica Huson

(74) *Attorney, Agent, or Firm* — Wilmer Cutler Pickering Hale and Dorr LLP

(57) ABSTRACT

A method for manufacturing an article of footwear includes providing a base portion of the article of footwear and providing a sheet. A pneumatic pressure differential is applied to the sheet to displace the sheet toward the base portion and shape the sheet against the base portion. The sheet is coupled to the base portion. Excess material is removed from the sheet such that a remainder of the sheet defines a portion of the article of footwear.

17 Claims, 11 Drawing Sheets

METHODS AND APPARATUS FOR MANUFACTURING ARTICLES OF FOOTWEAR INCLUDING DIFFERENT MATERIALS

CROSS-REFERENCE TO RELATED APPLICATION

This application claims the benefit of U.S. Provisional Patent Application Ser. No. 62/028,754, filed on Jul. 24, 2014, which is incorporated by reference herein in its entirety for all purposes.

TECHNICAL FIELD

Embodiments of the present disclosure relate to methods for manufacturing an article of footwear. More specifically, embodiments of the present disclosure relate to methods for manufacturing articles of footwear that include different materials.

BACKGROUND

Processes for forming portions of articles of footwear are typically specific to the materials that are used. For example, if fabric is used to form a layer of an upper of an article of footwear, the fabric is typically cut from a sheet of material and stitched to other portions of the article of footwear. However, if it was desired to instead form the layer of the upper with a different material, such as a polymer foam, different processes would likely be used, such as injection molding and gluing. As such, a single material difference between otherwise similar articles of footwear may lead to significant expenses because different types of manufacturing equipment may be needed.

SUMMARY

A method for manufacturing an article of footwear according to some embodiments of the present disclosure includes providing a base portion of the article of footwear and providing a sheet. A pneumatic pressure differential is applied to the sheet to displace the sheet toward the base portion and shape the sheet against the base portion. The sheet is coupled to the base portion. Excess material is removed from the sheet such that a remainder of the sheet defines a portion of the article of footwear.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

DETAILED DESCRIPTION

Figure 1:
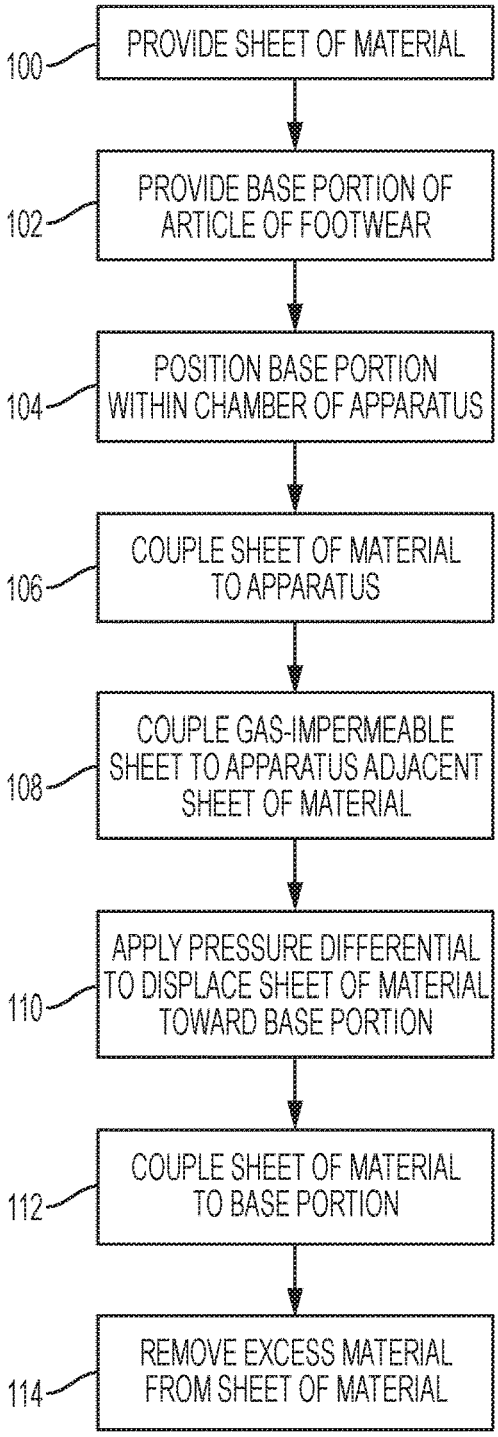
FIG. 1 illustrates an exemplary method for manufacturing an article of footwear according to embodiments of the present disclosure.
Figure 2:
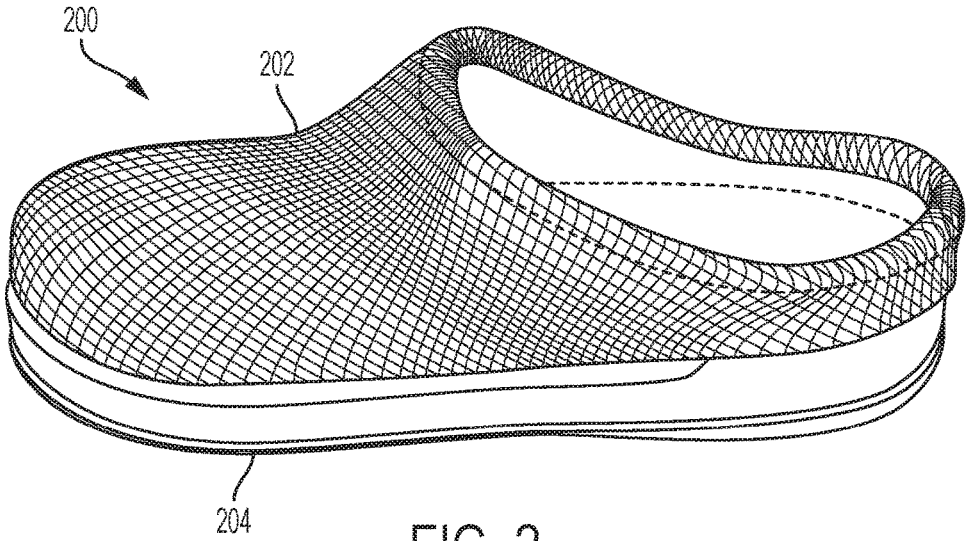
FIG. 2 illustrates a partial perspective view of an exemplary article of footwear manufactured according to the method of FIG. 1.
Figure 3:
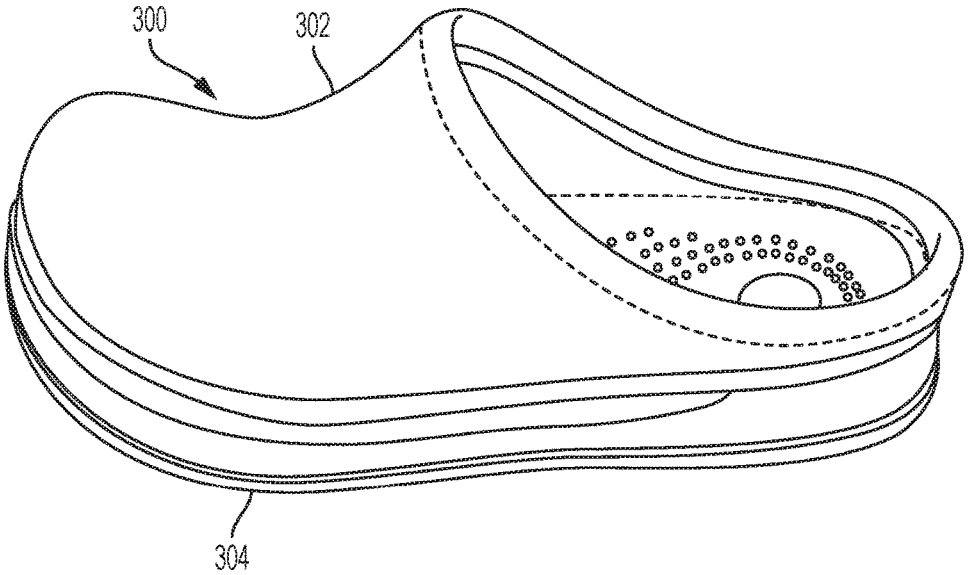
FIG. 3 illustrates a partial perspective view of another exemplary article of footwear manufactured according to the method of FIG. 1.

FIG. 1 illustrates an exemplary method for manufacturing one or more articles of footwear, such as the articles of footwear 200 and 300 shown in FIGS. 2 and 3, respectively. Articles of footwear manufactured according to the method may be, for example, clogs as shown in FIGS. 2 and 3, casual shoes, running shoes, golf shoes, walking shoes, tennis shoes, molded shoes, shoes with cleats, shoes without cleats, hiking boots, ski boots, roller skate shoes, roller blade shoes, ice skating shoes, sandals, or any other kind of shoe or footwear.

Generally, the method illustrated in FIG. 1 includes forming or shaping a first portion of an article of footwear, such as an outer layer of a vamp or upper 202, 302, over a second portion of the article of footwear, such as a combined sole and inner layer of the upper 204, 304. The method applies a pneumatic pressure differential to opposite sides of a sheet of material that ultimately forms the first portion to form or shape the first portion over the second portion.

Figure 4:
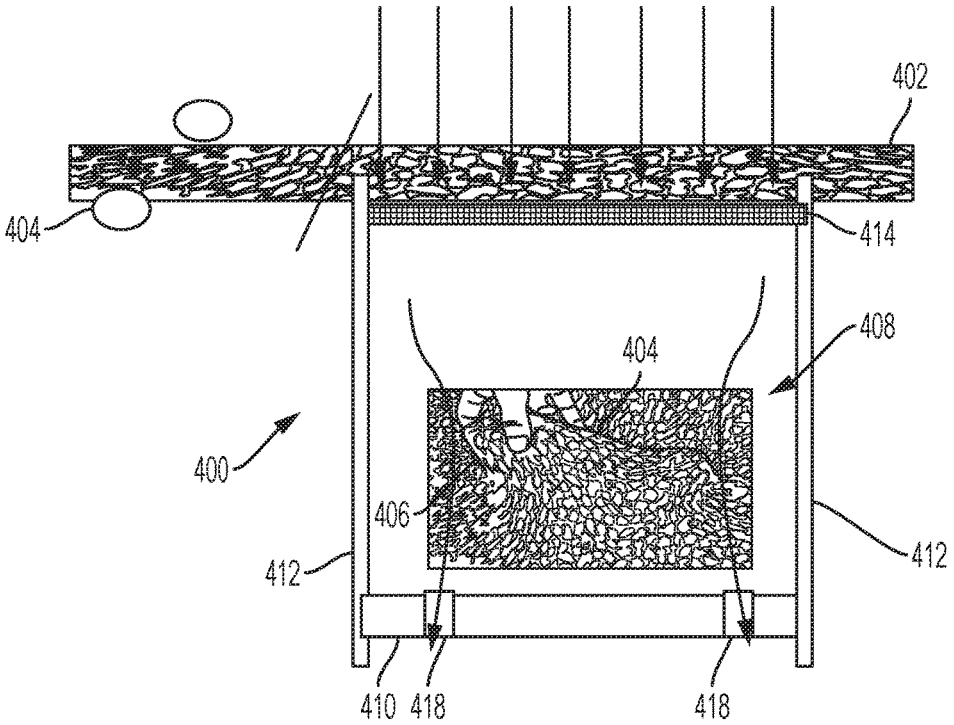
FIG. 4 illustrates a schematic of an exemplary pneumatic pressure differential apparatus for manufacturing an article of footwear according to the method of FIG. 1.

FIG. 4 illustrates an exemplary pneumatic pressure differential apparatus 400 for manufacturing an article of footwear according to the method of FIG. 1. The method begins at block 100 by providing a sheet of material 402 that ultimately forms a first portion of the article of footwear. The sheet 402 may be formed of various stretchable and/or flexible materials, such as, for example, fabrics, textiles, leathers, polymer films, and the like, as well as combinations thereof or multiple layers formed by two or multiples thereof. The sheet 402 may include various colors, decorative features, thicknesses, and other physical characteristics. In some embodiments and as shown in FIG. 4, the sheet 402 is fed from a roll of material (not shown) using one or more rollers 404. The sheet 402 is then cut to an appropriate size. In some embodiments, sheets 402 are initially formed as separate components.

At block 102, the method continues by providing a second or base portion 404 of the article of footwear. In some embodiments, the base portion 404 may be a different material than the sheet of material 402 (that is, the sheet of material 402 may be a first material, and the base portion 404 may be a second material). For example, the base portion 404 may be formed of a copolymer resin foam, particularly ethylene vinyl acetate (EVA). The base portion 404 may be formed in various manners, such as via an injection molding process. Specifically, the base portion 404 may be manufactured in the manner described in U.S. Pat. No. 6,439,536, granted on Aug. 27, 2002, which is hereby incorporated by reference.

Figure 6:
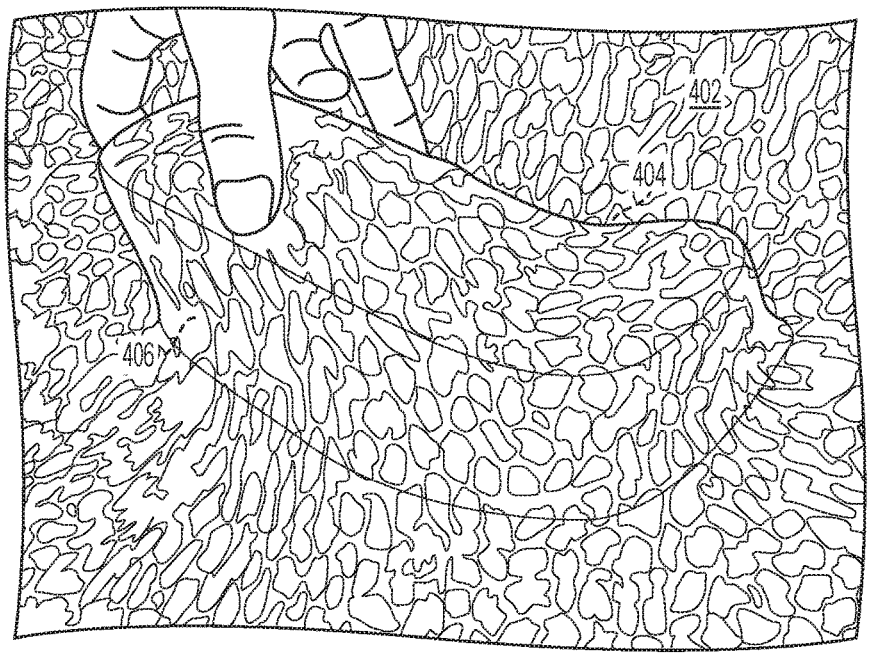
FIG. 6 illustrates a top perspective view of a sheet of material shaped over a base portion of an article of footwear using the apparatus of FIG. 4.
Figure 7:
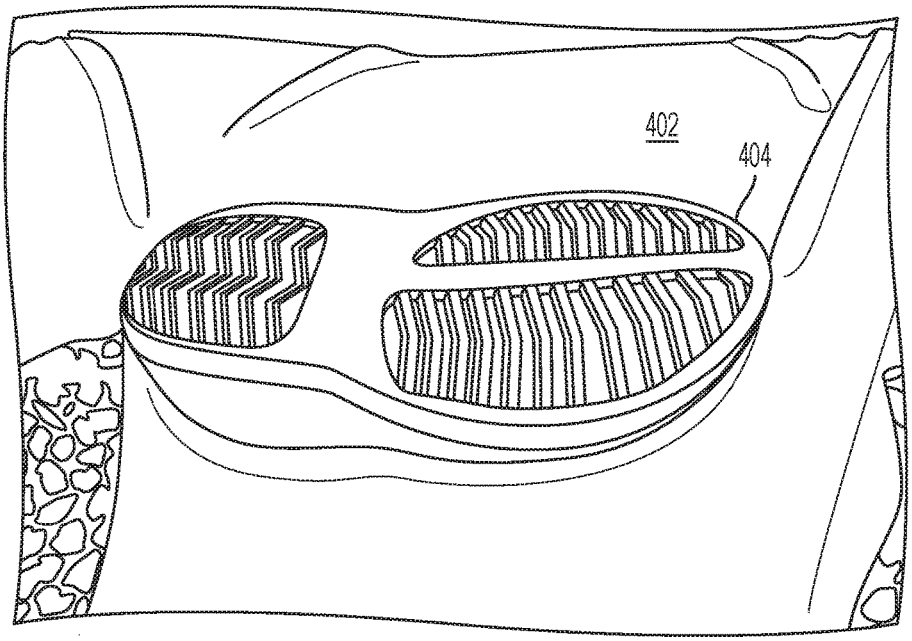
FIG. 7 illustrates a bottom perspective view of the sheet of material and the base portion of FIG. 6.
Figure 8:
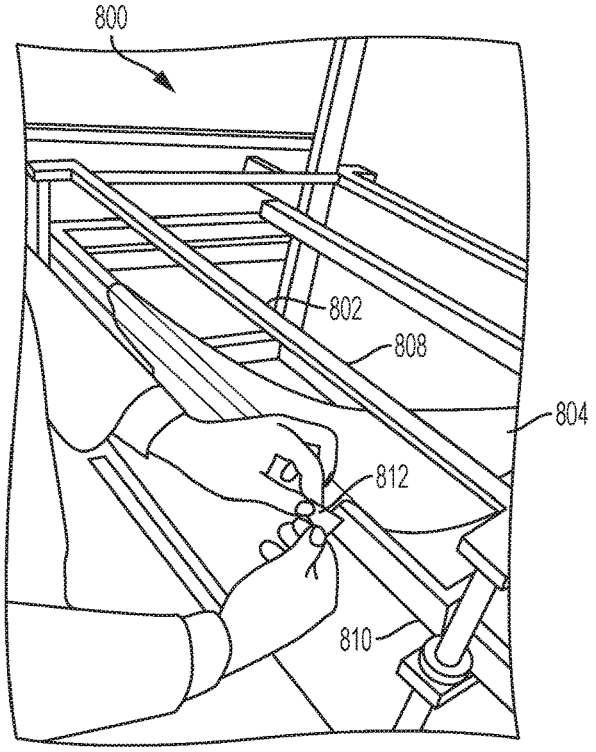
FIG. 8 illustrates a perspective view of another exemplary pneumatic pressure differential apparatus for manufacturing an article of footwear according to the method of FIG. 1; walls of the apparatus are removed for illustrative purposes, and a sheet of material is being coupled to a frame of the apparatus.
Figure 9:
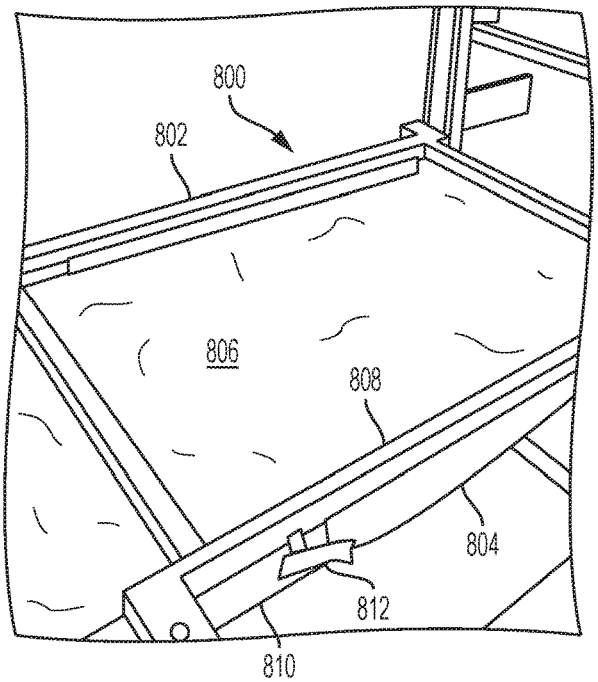
FIG. 9 illustrates another perspective view of the apparatus of FIG. 8; the sheet of material and a hermetic sheet are coupled to the frame of the apparatus.
Figure 10:
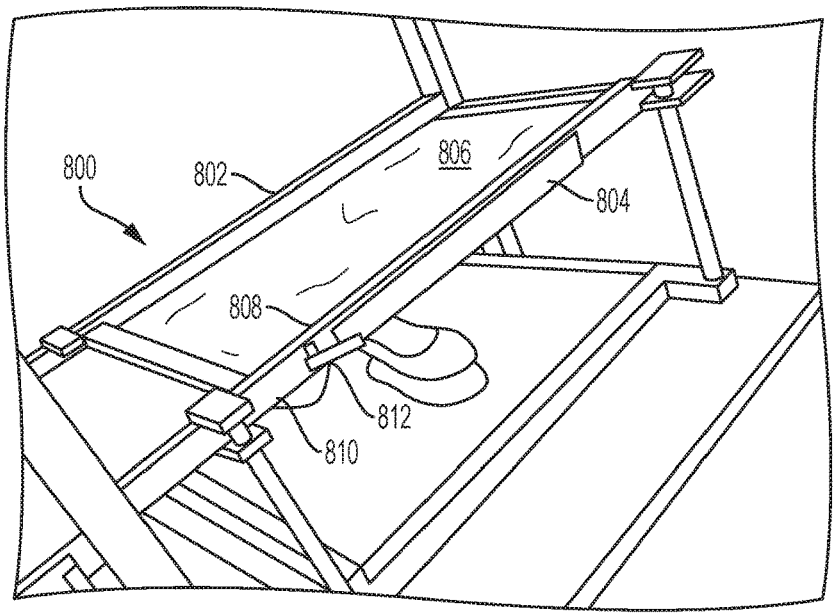
FIG. 10 illustrates another perspective view of the apparatus of FIG. 8 in which the sheet of material and the hermetic sheet are coupled to the frame of the apparatus, and a base portion of an article of footwear is positioned within a chamber of the apparatus.
Figure 11:
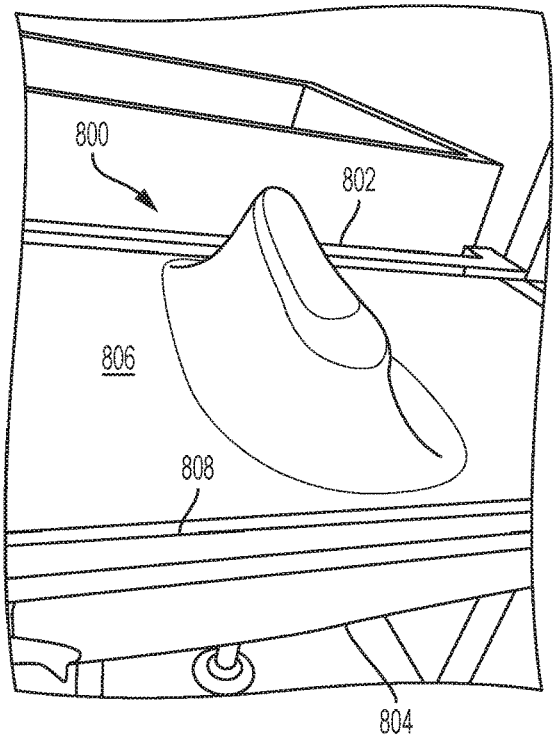
FIG. 11 illustrates another perspective view of the apparatus of FIG. 8 in which the sheet of material and the hermetic sheet are shaped over the base portion of the article of footwear.

In some embodiments, the base portion 404 may carry a last 406 (see FIGS. 4 and 6). The purpose of the last 406 is described in further detail below.

Figure 5:
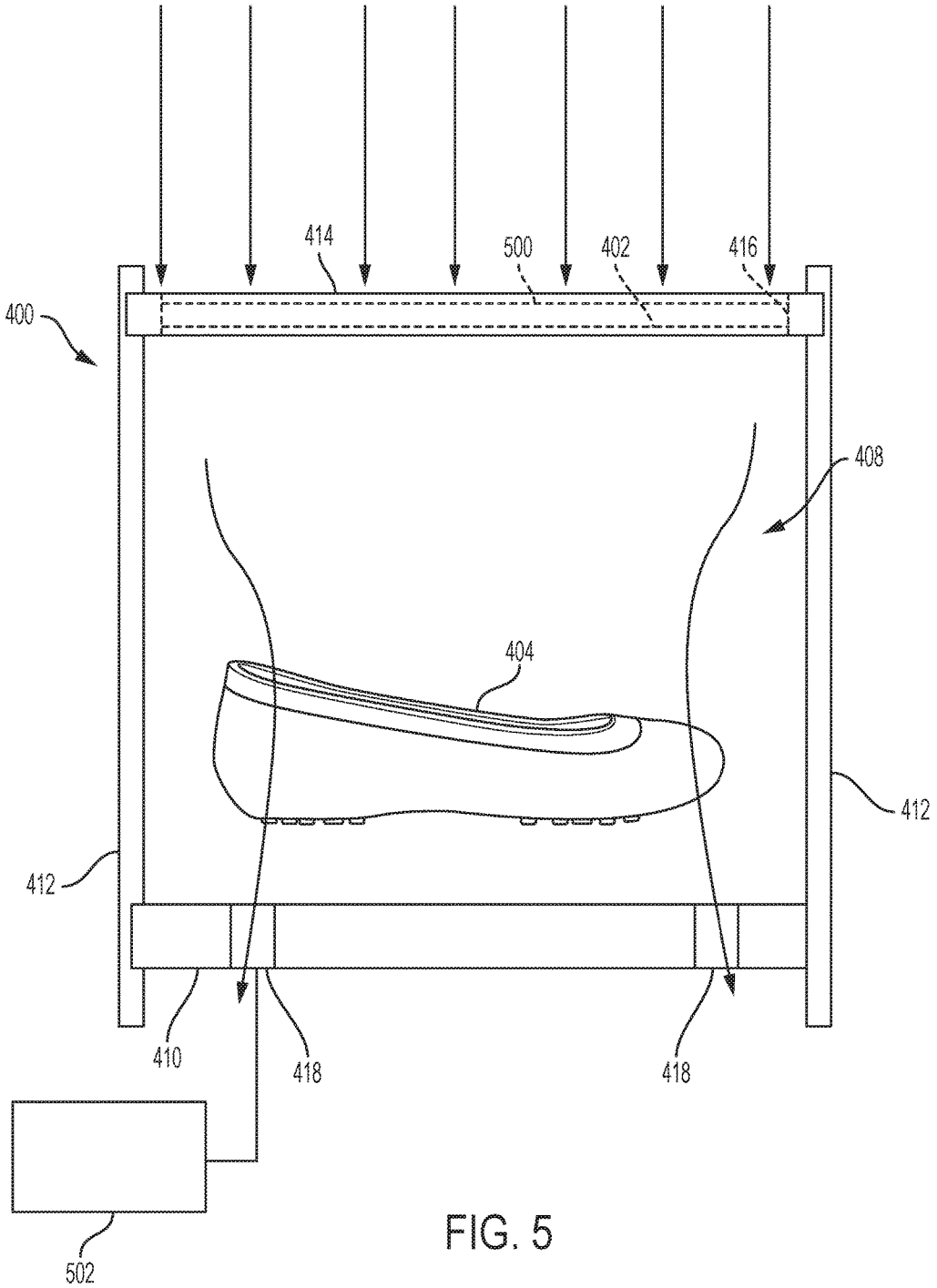
FIG. 5 illustrates another schematic of the apparatus of FIG. 4.

At block 104, the method continues by positioning the base portion 404 within a chamber 408 of a pneumatic pressure differential apparatus 400 for shaping a first portion of an article of footwear. In some embodiments, the apparatus 400 generally includes five walls, for example, a floor 410 and four side walls 412, two of which are shown in FIGS. 4 and 5, and a frame 414 having an opening 416 (see FIG. 5), for example, at or near the top of the chamber 408. At block 106, the sheet of material 402 is coupled to the frame 414 within the opening 416.

In some embodiments, the sheet 402 is hermetic. That is, the sheet 402 is sufficiently "gas-tight" or "air-tight" such that a pneumatic pressure differential across the sheet 402 displaces the sheet 402. Stated another way, the sheet 402, together with the walls of the apparatus 400, is capable of isolating the chamber 408 from the outside of the apparatus 400 (that is, to make the chamber 408 "gas-tight" or "air-tight"). This may be the case if the sheet 402 is formed by a polymer film. In other embodiments, the sheet 402 is non-hermetic. This may be the case if the sheet 402 is formed by a fabric. In these embodiments, the method continues at block 108 by coupling a hermetic sheet 500 (see FIG. 5) to the frame 414 adjacent the sheet of material 402. The hermetic sheet 500 is sufficiently "gas-tight" or "air-tight" such that a pneumatic pressure differential across the hermetic sheet 500 displaces the hermetic sheet 500. The hermetic sheet 500 may be formed of various stretchable materials, such as polymers and the like. The hermetic sheet 500 is positioned adjacent the surface of the sheet of material 402 that faces away from the chamber 408. That is, in some embodiments, the hermetic sheet 500 overlies the sheet of material 402.

In some embodiments, one or more adhesives are then applied to the sheet of material 402 and/or the base portion 404. Heat is then applied to melt the adhesives. In some embodiments, the sheet of material 402 is pre-formed with an adhesive on the surface that faces the chamber 408. Heat is then applied to melt the adhesive.

At block 110, the method continues by applying a pneumatic pressure differential to the chamber 408 (that is, across the sheet 402 and the hermetic sheet 500, if present) to move the sheet of material 402 toward the base portion 404 (see FIG. 6). In some embodiments, the frame 414 moves toward the base portion 404 to move the sheet of material 402 and the hermetic sheet 500, if present, toward the base portion 404. In other embodiments, the sheet of material 402 and the hermetic sheet 500, if present, stretch to move toward the base portion 404 while the frame 414 remains stationary. In any case, the sheet of material 402 stretches and engages the base portion 404 and the last 406, if present, and the base portion 404 and the last 406, if present, act as forming surfaces for the sheet of material 402. That is, the base portion 404 and the last 406, if present, shape the sheet of material 402 thereover.

According to some embodiments of the present disclosure, the sheet of material 402 is moved toward the base portion before or during application of the pneumatic pressure differential, to bring them closer together. For example, the base portion 404 may be raised mechanically or otherwise upwards toward the sheet 402 so that the sheet 402 has a smaller distance to travel when the pneumatic pressure differential (e.g. vacuum) is applied. Similarly, the sheet 402 may be lowered toward the base portion 404 before or during application of the pneumatic pressure differential; or, the sheet 402 could be simultaneously lowered while the base portion 404 is raised, either before or during or after application of the pneumatic pressure differential.

In some embodiments, the pneumatic pressure differential is applied by reducing pressure within the chamber or creating a vacuum within the chamber 408. To this end, one or more of the walls of the apparatus 400, such as the floor 410, may include one or more vents 418 that are in fluid communication with a pressure-reducing device 502 (see FIG. 5), such as a pump. In some embodiments, the pneumatic pressure differential is additionally or alternatively applied by increasing pressure on the side of the sheet 402 (or the hermetic sheet 500, if present) that faces away from the chamber 408. This pneumatic pressure differential facilitates the sheet of material 402 conforming more closely to the base portion 404, more quickly, than would normally be possible with an attempted manual application and/or via the use of only rollers or the like to smooth the sheet of material 402 over the base portion 404.

At block 112, the method continues by coupling the sheet of material 402 to the base portion 404. In some embodiments, the adhesives are cured to couple the sheet of material 402 to the base portion 404. In some embodiments, stitching is applied to couple the sheet of material 402 to the base portion 404. In some embodiments, non-curing adhesives or glues are used for the coupling. In some embodiments, the sheet of material 402 is coupled to the base portion 404 in two or more ways, for example by adhesive and by stitching. The hermetic sheet 500, if present, is removed from the apparatus 400.

At block 114, the method continues by removing excess material from the sheet 402 such that the remainder of the sheet 402 forms a portion of the article of footwear. In some embodiments, the excess material is cut from the sheet 402. In some embodiments, material is removed from a foot opening and around the perimeter of the sole of the article of footwear such that the remainder of the sheet 402 forms an outer layer of the vamp or upper. In some embodiments, material is removed from the foot opening by cutting at the interface between the base portion 404 and the last 406. The last 406 is then removed from the base portion 404.

In some embodiments, the method includes removing excess material from the sheet before coupling the sheet to the base portion 404.

In some embodiments, the method is used to simultaneously manufacture multiple articles of footwear or a pair of articles of footwear (that is, "right" and "left" articles of footwear). In these embodiments, a single sheet of material may be used to simultaneously engage multiple base portions or a pair of base portions. As such, a single sheet of material may form portions of multiple articles of footwear or a pair of articles of footwear.

In some embodiments, the method additionally includes forming or adding other features to the article of footwear. For example, holes may be formed in the vamp, decorative features may be coupled to the article of footwear, a heel strap may be coupled to the article of footwear, laces may be coupled to the article of footwear, and/or the like.

In some embodiments, the method further includes replacing the material that forms the sheet 402 with a different type of material and then repeating the actions described above to form a second article of footwear. That is, a first material, such as a fabric, may be provided. A sheet of the first material may be used with the method and apparatus described above to form a first article of footwear. The first material may then be replaced by a second material, such as a polymer film. A sheet of the second material may be used with the method and apparatus described above to form a second article of footwear. This process may continue with any number of different materials. As such, methods and apparatus according to some embodiments of the present disclosure permit articles of footwear with material differences to be relatively easily and inexpensively manufactured.

In some embodiments, the methods described above may include additional actions, fewer actions, and/or include different temporal orders than those described above. For example, excess material may be removed from the sheet before coupling the sheet to the base portion of the article of footwear.

FIGS. 8-11 illustrate another exemplary pneumatic pressure differential apparatus 800 for manufacturing an article of footwear according to the method of FIG. 1. The apparatus 800 is similar to the apparatus 400 described above, although the chamber walls are removed for illustrative purposes. In addition, the apparatus 800 includes a multiple-component frame 802 for coupling a sheet of material 804 and a hermetic sheet 806, if present. The frame 802 includes a first frame portion 808 that is movably coupled to a second frame portion 810. The first and second frame portions 808 and 810 may be moved toward each other to couple the sheet 804 and the hermetic sheet 806, if present, therebetween. The sheet 804 and the hermetic sheet 806, if present, may be further coupled to the frame 802 via additional components, such as temporary adhesives (for example, tape 812) and the like.

Figure 12:
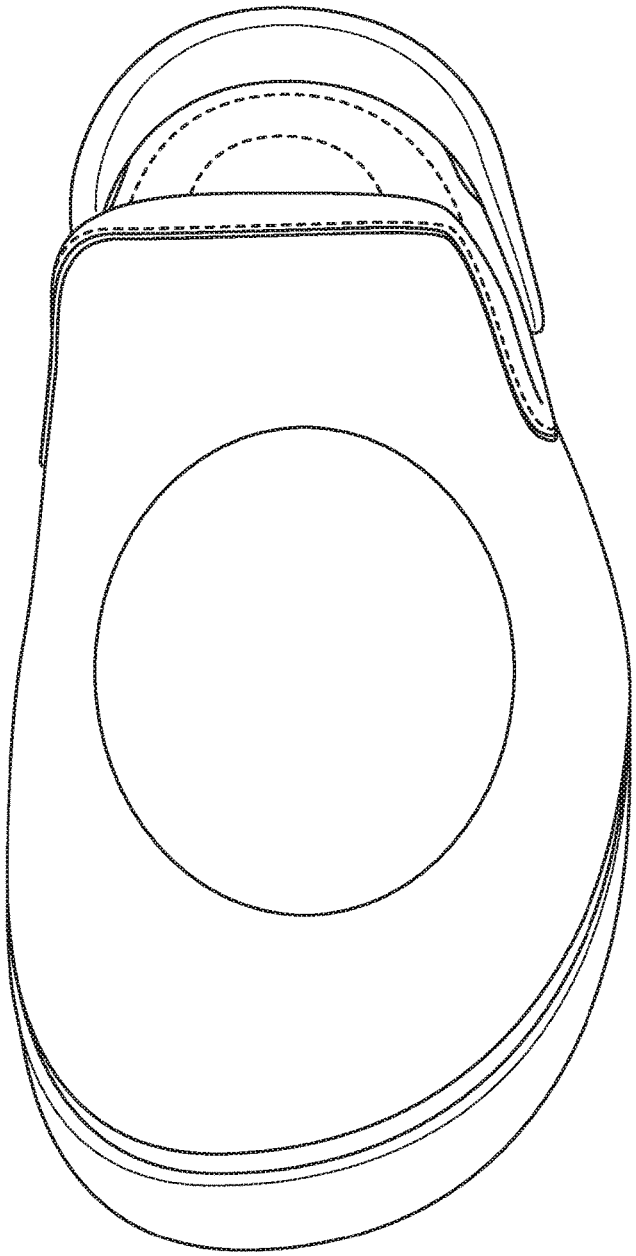
FIG. 12 illustrates front perspective view of a shoe manufactured according to embodiments of the present disclosure.
Figure 13:
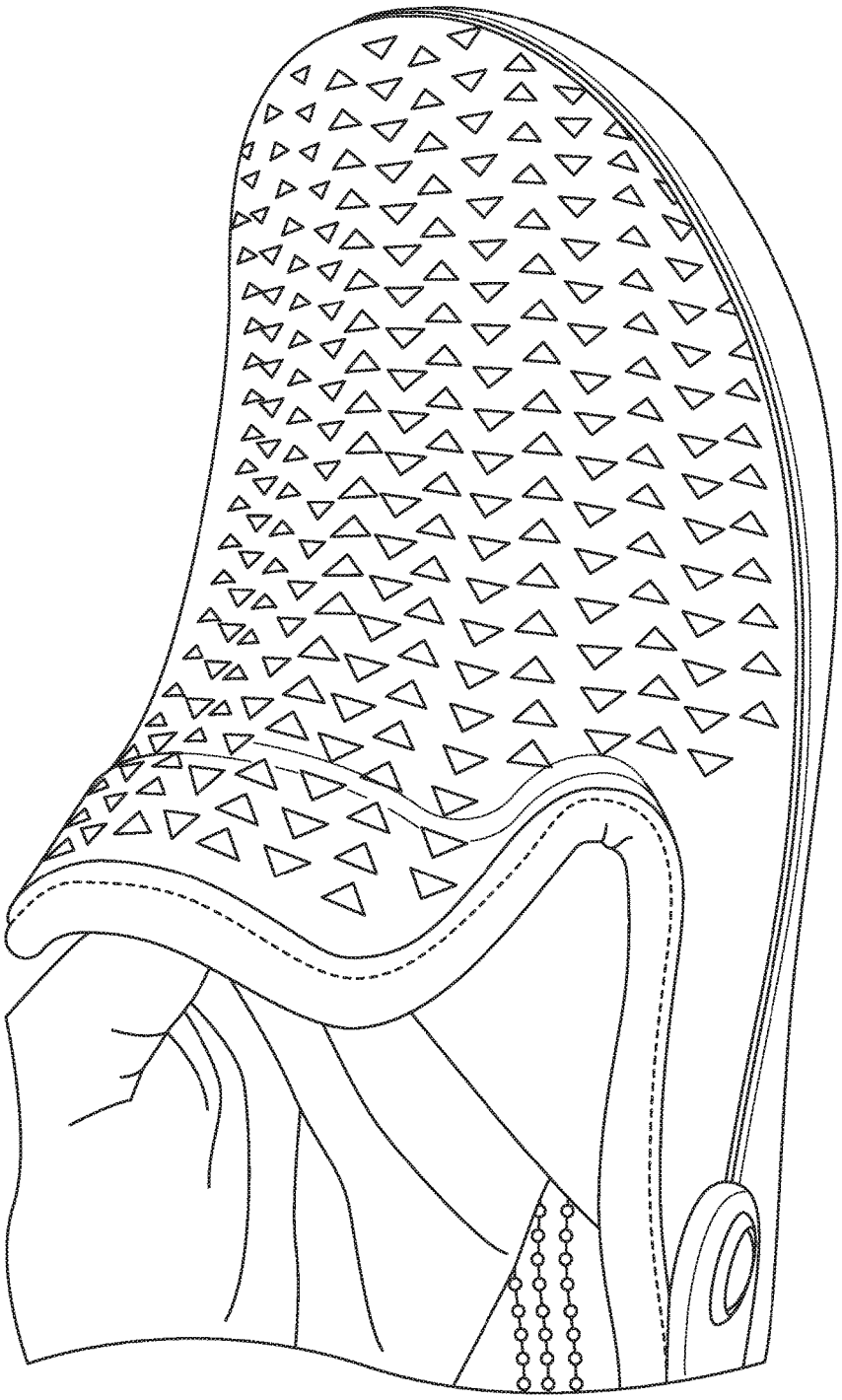
FIG. 13 illustrates a top perspective view of another shoe manufactured according to embodiments of the present disclosure, having the same base portion as that of FIG. 12 but a different sheet of material applied to the base portion.

FIGS. 12 and 13 illustrate different sheets of material (e.g. outer layers) applied to the same base portion, according to embodiments of the present disclosure. These figures illustrate that methods according to embodiments of the present disclosure can be used to customize the same base portion (or one of many base portions) in many different ways. As described above, the sheet of material used in the pneumatic pressure differential (or vacuum) process can be polymer, plastic, resin molded foam, leather, textile, and the like, and/or combinations thereof.

Figure 14:
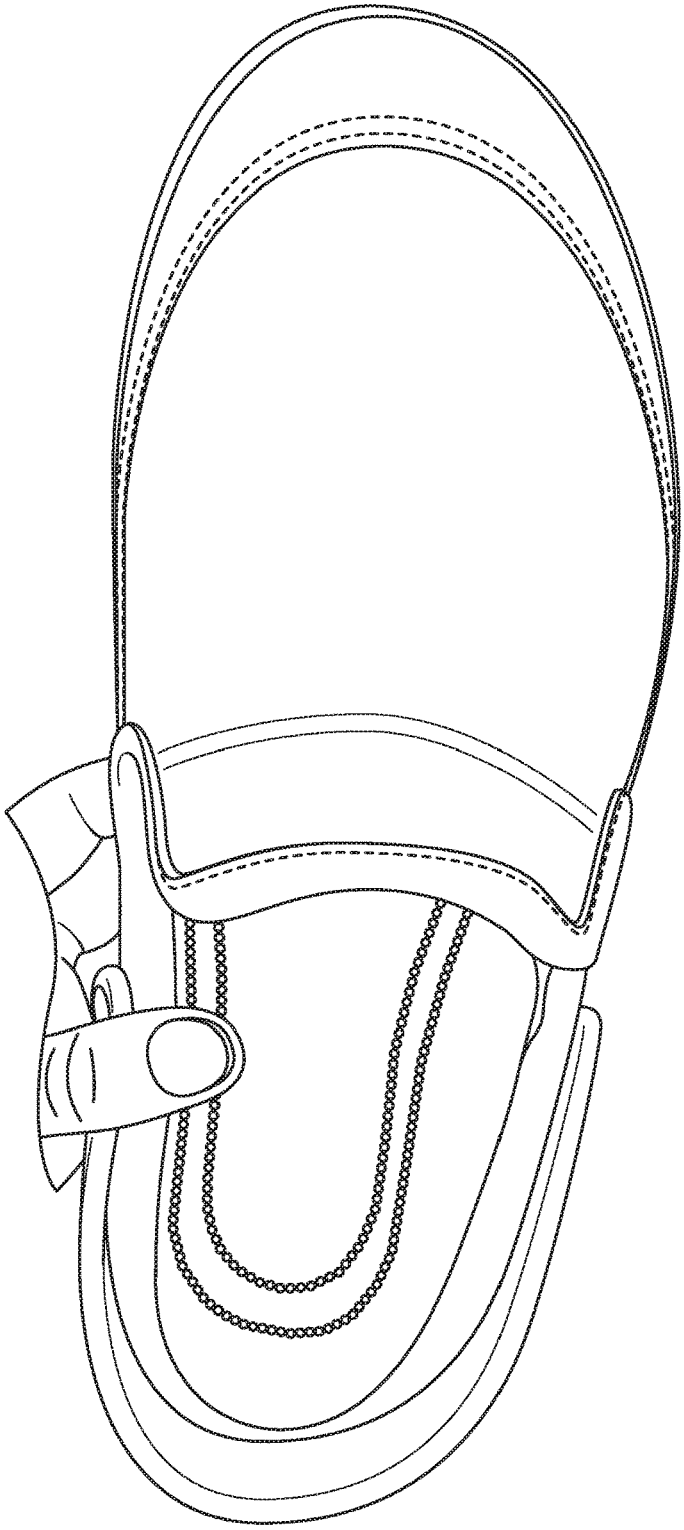
FIG. 14 illustrates a top view of yet another shoe manufactured according to embodiments of the present disclosure, having the same base portion as those of FIGS. 12 and 13, but a different combination of materials applied to the base portion.
Figure 15:
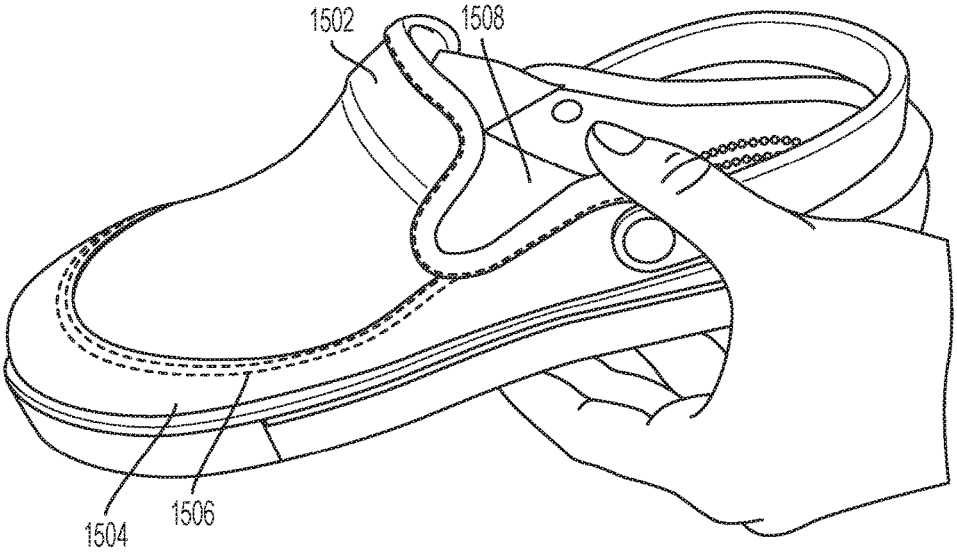
FIG. 15 illustrates a side perspective view of the shoe of FIG. 14.
Figure 16:
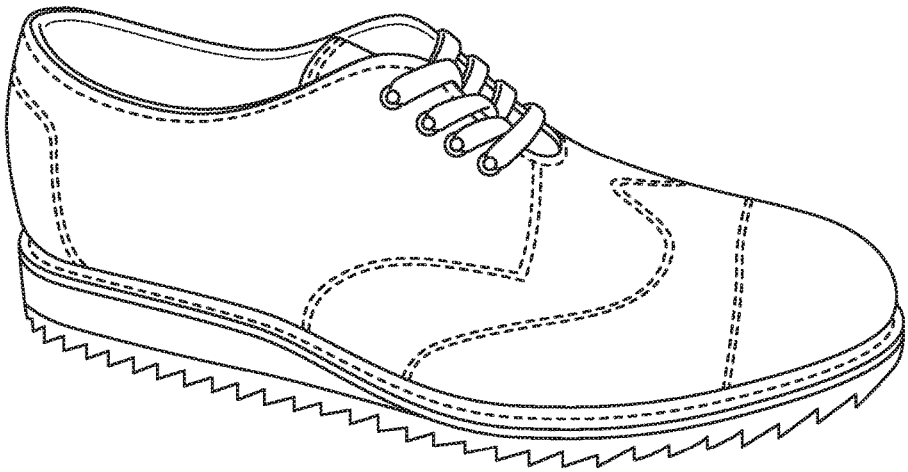
FIG. 16 illustrates a side and front perspective view of yet another shoe manufactured according to embodiments of the present disclosure.

FIGS. 14 and 15 illustrate another shoe having the same base portion as those of FIGS. 12 and 13, with a combination textile layer added to the upper. The combination textile layer may include, by way of example and not limitation, a first portion 1502 and a second portion 1504 (these portions may be the same or different or other materials). For example, first portion 1502 may be canvas, and second portion 1504 may be leather. The portions 1502 and 1504 may be stitched together according to a pattern or form at stitching 1506, and may also include other elements such as elastic ribbing or inserts 1508. According to some embodiments, two or more of portions 1502, 1504, 1506, and 1508 may be combined when all of such elements are flat or otherwise in a two-dimensional configuration with respect to each other, and then such combined elements may form a combination textile layer that may be coupled to a molded base portion in the manner described with respect to sheets 402 being coupled with molded base portion 404. Combining or stitching or adhering or gluing multiple upper or vamp elements when such elements are in their flattened or unassembled configurations is easier and less expensive and less time consuming than adding such elements separately to the base portion or attempting to stitch or glue elements to each other or the base portion after application to the base portion. According to some embodiments, the excess of the sheets formed by elements 1502 and 1504 may include portions of both 1502 and 1504, or alternatively the excess material of element 1502 could be trimmed (below stitching 1506) so that after coupling the sheet with the base portion, only excess from element 1504 is trimmed. Sheets 402 (and others) according to embodiments of the present disclosure need not be airtight in order to conform to the base portion under the pneumatic pressure differential; in other embodiments, sheets 402 that are not sufficiently airtight may be applied using a separate sheet such as a hermetic sheet 500. FIG. 16 illustrates yet another example of a shoe that may be manufactured according to embodiments of the present disclosure, including stitching which may be added to the outer sheet before the outer sheet is coupled to the base portion via the processes described herein.

Embodiments of the present disclosure also permit footwear products to be manufactured in stages, and/or in different geographical locations. For example, molded base portions 404 may be molded in a first location, for example a first country, and imported into a second location, for example a second country, and the pneumatic pressure differential process described herein may be used to add sheets 402 to form different uppers in the second location or second country. Embodiments of the present disclosure may permit shoes or base portions to be decorated in an environment other than the factory in which the base portions were molded, for example.

Various other modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A method for manufacturing an article of footwear, comprising:

positioning a sheet in proximity with a base portion of the article of footwear;

applying a pneumatic pressure differential to the sheet to displace the sheet toward the base portion and shape the sheet against the base portion;

coupling the sheet to the base portion; and removing excess material from the sheet such that a remainder of the sheet coupled to the base portion defines a portion of the article of footwear.

2. The method of claim 1, wherein the base portion comprises a combined sole and inner layer of an upper of the article of footwear, and the remainder of the sheet comprises an outer layer of the upper.

3. The method of claim 1, further comprising:

positioning the base portion within a chamber of a pneumatic pressure differential apparatus;

coupling the sheet to the pneumatic pressure differential apparatus; and wherein applying the pneumatic pressure differential to the sheet comprises applying the pneumatic pressure differential to the chamber to displace the sheet toward the base portion and shape the sheet against the base portion.

4. The method of claim 3, wherein applying the pneumatic pressure differential to the chamber comprises reducing pressure within the chamber.

5. The method of claim 3, wherein the pneumatic pressure differential apparatus comprises a plurality of walls that define the chamber and a frame coupled to the walls, the frame comprising an opening, and wherein coupling the sheet to the apparatus comprises coupling the sheet to the frame within the opening.

6. The method of claim 3, wherein the sheet is a non-hermetic sheet, and further comprising:

providing a hermetic sheet;

coupling the hermetic sheet to the pneumatic pressure differential apparatus adjacent the non-hermetic sheet; and wherein applying the pneumatic pressure differential comprises applying the pneumatic pressure differential to the hermetic sheet to displace the hermetic sheet and the non-hermetic sheet toward the base portion and shape the non-hermetic sheet against the base portion.

7. The method of claim 1, wherein removing the excess material from the sheet comprises cutting the excess material from the sheet.

8. The method of claim 1, wherein coupling the sheet to the base portion comprises at least one of adhering and stitching the sheet to the base portion.

9. The method of claim 1, wherein the sheet comprises one or a combination of fabric, textile, leather, and polymer film.

10. The method of claim 1, wherein the base portion comprises ethylene vinyl acetate (EVA).

11. The method of claim 1, wherein the base portion is completely formed of ethylene vinyl acetate (EVA).

12. The method of claim 9, wherein the base portion comprises ethylene vinyl acetate (EVA).

13. The method of claim 9, wherein the base portion is completely formed of ethylene vinyl acetate (EVA).

14. The method of claim 1, wherein the sheet is a first sheet, wherein the first sheet comprises a first material, wherein the base portion is a first base portion and the article of footwear is a first article of footwear, the method further comprising manufacturing a second article of footwear by:

positioning a second sheet in proximity with a second base portion of the second article of footwear, the second sheet comprises a second material, the second material being different than the first material;

applying a second pneumatic pressure differential to the second sheet to displace the second sheet toward the second base portion and shape the second sheet against the second base portion;

coupling the second sheet to the second base portion; and removing excess material from the second sheet such that a remainder of the second sheet defines a portion of the second article of footwear.

15. The method of claim 1, wherein the article of footwear is a first article of footwear, wherein the base portion is a first base portion of the first article of footwear, the method further comprising:

positioning the sheet in proximity with a second base portion of a second article of footwear;

applying the pneumatic pressure differential to the sheet to displace the sheet toward the first and second base portions and shape the sheet against the first and second base portions simultaneously;

coupling the sheet to the first and second base portions; and removing excess material from the sheet such that a first remainder of the sheet defines a portion of the first article of footwear and a second remainder of the sheet defines a portion of the second article of footwear.

16. The method of claim 1, further comprising applying an adhesive to one or both of an underside of the sheet and an outer surface of the base portion, and wherein coupling the sheet to the base portion comprises placing the adhesive into contact with the base portion and the sheet.

17. The method of claim 16, further comprising setting or curing the adhesive after coupling the sheet to the base portion.

* * * * *